US008254077B2

(12) United States Patent
Fukano et al.

(10) Patent No.: US 8,254,077 B2
(45) Date of Patent: Aug. 28, 2012

(54) SOLENOID VALVE DRIVING CIRCUIT, SOLENOID VALVE, AND SOLENOID VALVE DRIVING METHOD

(75) Inventors: Yoshihiro Fukano, Moriya (JP); Shigeharu Oide, Adachi-ku (JP); Takayoshi Hatou, Toride (JP); Hidenori Ogawa, Kawagoe (JP)

(73) Assignee: SMC Kabushiki Kaisha, Tokyo (JP)

( * ) Notice: Subject to any disclaimer, the term of this patent is extended or adjusted under 35 U.S.C. 154(b) by 51 days.

(21) Appl. No.: 12/872,365

(22) Filed: Aug. 31, 2010

(65) Prior Publication Data

US 2011/0214741 A1 Sep. 8, 2011

(30) Foreign Application Priority Data

Mar. 3, 2010 (JP) ..... 2010-046550

(51) Int. Cl.
*H01H 47/00* (2006.01)
*H01H 47/32* (2006.01)

(52) U.S. Cl. ..... 361/139; 361/152; 361/154; 361/187

(58) Field of Classification Search ..... 361/139, 361/152, 154, 187
See application file for complete search history.

(56) References Cited

U.S. PATENT DOCUMENTS 4,823,825 A * 4/1989 Buchl ..... 137/1
4,907,901 A * 3/1990 Mitchell ..... 400/157.2
5,479,156 A * 12/1995 Jones ..... 340/5.64
6,386,229 B1 5/2002 Morikawa et al.
6,744,615 B1 * 6/2004 Melbert et al. ..... 361/154
2009/0015979 A1 1/2009 Fukano et al.

FOREIGN PATENT DOCUMENTS

| | | |
|---|---|---|
| JP | 4-211777 | 8/1992 |
| JP | 8-291877 | 11/1996 |
| JP | 2002-181220 | 6/2002 |
| JP | 3530775 | 3/2004 |
| JP | 2005-61584 | 3/2005 |
| JP | 4359855 | 8/2009 |

OTHER PUBLICATIONS

Office Action issued Dec. 20, 2011, in Japanese Patent Application No. 2010-046550 (with partial English-language translation).

* cited by examiner

*Primary Examiner* — Rexford Barnie
*Assistant Examiner* — Zeev V Kitov
(74) *Attorney, Agent, or Firm* — Oblon, Spivak, McClelland, Maier & Neustadt, L.L.P.

(57) ABSTRACT

A solenoid valve driving circuit for a solenoid valve includes a current detector for detecting a current that flows in a solenoid coil, a rate of change over time calculating unit for calculating a rate of change over time of the detected current, and a maintaining state transition determining unit for determining a timing at which transition from a first period to a second period occurs based on the calculated rate of change over time.

10 Claims, 6 Drawing Sheets

SWITCH ON
SWITCH OFF
POWER SOURCE VOLTAGE
(+)
0
Vo

CURRENT FLOWING IN SOLENOID COIL
(+)
0
I1
I2
I3
I4
T7
T9

CURRENT CHANGE RATE
(+)
0
(−)
t0
t1
t2
t3
t4
t5
t6
T2
T3
T4
T14
T5
T12

CONTROL SIGNAL
(+)
0
T1
T10

VOLTAGE APPLIED TO SOLENOID COIL
(+)
0
Vo
TIME

SWITCH ON
SWITCH OFF
POWER SOURCE VOLTAGE
(+)
0
Vo

CURRENT FLOWING IN SOLENOID COIL
(+)
0
I1
I2
I3
I4
T7
T9

CURRENT CHANGE RATE
(+)
0
(−)
t0
t1
t5
t6
T2
T11

CONTROL SIGNAL
(+)
0
T1
T10

VOLTAGE APPLIED TO SOLENOID COIL
(+)
0
Vo
TIME

SWITCH ON
SWITCH OFF
POWER SOURCE VOLTAGE
(+)
0
Vo

CURRENT FLOWING IN SOLENOID COIL
(+)
0
I1
I2
I3
I4
T7
T9

CURRENT CHANGE RATE
(+)
0
(−)
t0
t1
t2
t5
t6
T2
T3
T8
T13

CONTROL SIGNAL
(+)
0
T1
T10

VOLTAGE APPLIED TO SOLENOID COIL
(+)
0
Vo
TIME

SWITCH ON
SWITCH OFF
POWER SOURCE VOLTAGE
(+)
0
Vo

CURRENT FLOWING IN SOLENOID COIL
I1
I2
I3
I4
T7
T9

CURRENT CHANGE RATE
(−)
t0
t1
t2
t3
t8
t5
t9
t6
T2
T3
T4
T5
T6
T19

CONTROL SIGNAL
T15
T17
T1
T16
T18
T10

VOLTAGE APPLIED TO SOLENOID COIL
TIME

SOLENOID VALVE DRIVING CIRCUIT, SOLENOID VALVE, AND SOLENOID VALVE DRIVING METHOD

CROSS-REFERENCE TO RELATED APPLICATION

This application is based upon and claims the benefit of priority from Japanese Patent Application No. 2010-046550 filed on Mar. 3, 2010, of which the contents are incorporated herein by reference.

BACKGROUND OF THE INVENTION

1. Field of the Invention

The present invention relates to a solenoid valve driving circuit for driving a solenoid valve by applying a first voltage with respect to a solenoid coil of the solenoid valve during a first period, and for maintaining a driven state of the solenoid valve by applying a second voltage with respect to the solenoid coil during a second period following the first period, as well as to a solenoid valve having such a solenoid valve driving circuit, and a solenoid valve driving method therefor.

2. Description of the Related Art

Heretofore, it has been widely practiced to arrange a solenoid valve midway along a fluid passage, and by applying a voltage to a solenoid coil of the solenoid valve from a solenoid valve driving circuit, to energize the solenoid valve in order to open and close the fluid passage. In this case, during a first period (activation time), the solenoid valve is activated by applying a first voltage to the solenoid coil from the solenoid valve driving circuit, and during a second period (maintenance time) following the first period, the solenoid valve is retained in a driven state by applying a second voltage to the solenoid coil from the solenoid valve driving circuit.

In recent years, in the aforementioned type of solenoid valve, it has been desired to drive the solenoid valve with low power consumption. In Japanese Patent No. 4359855, it has been proposed that by turning a switch ON and OFF based on current that flows through the solenoid coil, conduction (electrical continuity) between a power source and the solenoid coil is controlled, whereby the solenoid valve can be retained in a driven state using an even lower amount of power consumption.

On the other hand, there is a concern that when the solenoid valve is used over prolonged periods, the driving performance of the solenoid valve may become degraded. Consequently, in Japanese Patent No. 3530775, it has been proposed to detect operating times of the solenoid valve, and by judging whether or not switching operations of the solenoid valve are normal, to enable notification beforehand as to whether the solenoid valve is functioning abnormally before the solenoid valve suffers from a catastrophic fault.

Incidentally, during a first period when the solenoid valve is activated, a comparatively large amount of electrical energy (power) is supplied to the solenoid coil in order to quickly activate the solenoid valve, whereas during a second period when the solenoid valve is maintained in the driven state, a lower amount of electrical energy is supplied to the solenoid coil, whereby the solenoid valve that was activated during the first period is maintained in the driven state.

Concerning the second period, as noted above, by means of the technology of Japanese Patent No. 4359855, low power consumption can be obtained adequately.

However, in contrast thereto, concerning the first period when a comparatively large amount of electrical energy is supplied to the solenoid coil, from the standpoint of providing a solenoid valve having lower power consumption, it has been desired to be able to activate the solenoid valve using lower electrical energy, or more specifically, to activate the solenoid valve with a small activation current value, and with a short activation time.

SUMMARY OF THE INVENTION

An object of the present invention is to realize a further reduction in power consumption during the first period.

Further, another object of the present invention is to improve low power consumption of a solenoid valve and to improve reliability of the solenoid valve by enabling self-diagnosis of a usage limit (lifespan) of the solenoid valve.

For achieving the aforementioned objects, in a solenoid valve driving circuit and a solenoid valve according to the present invention, the solenoid valve driving circuit drives a solenoid valve by applying a first voltage with respect to a solenoid coil of the solenoid valve during a first period, and maintains a driven state of the solenoid coil by applying a second voltage with respect to the solenoid coil during a second period following the first period.

The solenoid valve driving circuit comprises a current detector for detecting a current that flows in the solenoid coil, a rate of change over time calculating unit for calculating a rate of change over time of the current, and a maintaining state transition determining unit for determining transition from the first period to the second period based on the rate of change over time.

Further, a solenoid valve driving method according to the present invention is characterized by driving a solenoid valve by applying a first voltage with respect to a solenoid coil of a solenoid valve during a first period, and for maintaining a driven state of the solenoid coil by applying a second voltage with respect to the solenoid coil during a second period following the first period.

The above method comprises the steps of detecting a current that flows in the solenoid coil, calculating a rate of change over time of the current, and determining transition from the first period to the second period based on the rate of change over time.

According to the present invention, since the current that flows in the solenoid coil is detected, the rate of change over time of the detected current is calculated, and a timing at which transition from the first period to the second period occurs is determined based on the calculated rate of change over time, the first period can be set to an appropriate time period corresponding to the specifications and state of the solenoid valve.

In this manner, by optimizing the first period, which corresponds to the activation time of the solenoid valve, the first period (activation time) can be shortened, and together therewith, the current value (activation current value) required for activating the solenoid valve can be made smaller. As a result, lower power consumption during the first period can be realized.

Further, since the timing at which the transition from the first period to the second period occurs can be determined, in the case that the operation time (an activation time of the solenoid valve consisting of the total of the first period and the second period) of the solenoid valve has been preset beforehand, if the first period becomes unusually long, it can be judged that the solenoid valve is approaching its usage limit. More specifically, by recognizing the timing at which the transition from the first period to the second period occurs, self-diagnosis of when the solenoid valve has reached its usage limit is enabled.

Accordingly, with the present invention, the first period is optimized, whereby low power consumption of the solenoid valve can be realized. Further, by recognizing the timing at which the transition from the first period to the second period occurs, self-diagnosis of the usage limit (lifespan) of the solenoid valve is enabled. As a result, reliability of the solenoid valve can be improved.

From this fact, with the present invention, even in the case that an electronic component such as a position sensor (e.g., the position sensor disclosed in Japanese Patent No. 3530775) is not installed in the solenoid valve, since the first period can be optimized, a reduction in cost of the solenoid valve and the solenoid valve driving circuit can be realized.

Incidentally, during the first period, the current that flows in the solenoid coil increases rapidly over time immediately after start of application of the first voltage, and when a magnetomotive force (activation force) caused by the current is applied with respect to a movable core (plunger) that constitutes the solenoid valve and to a valve body installed on the end of the plunger, the movable core is attracted to a fixed core (iron core) of the solenoid valve as a result of the activation force, whereupon over time the increased current decreases in value slightly. More specifically, concerning the increased current after initiation of application of the first voltage, the current value thereof reaches a maximum immediately before the plunger and the valve body start to be attracted with respect to the iron core, and thereafter, upon initiation of attraction of the plunger and the valve body with respect to the iron core, the current value begins to decrease (see FIG. 2B). Additionally, upon attraction of the plunger and the valve body to the iron core, activation of the solenoid valve is completed.

However, conventionally, there has been a concern that after the movable core and the valve body have been attracted to the iron core, the movable core and the valve body could possibly separate away from the iron core, thereby releasing the attracted state. Thus, in terms of design considerations, current continues to be applied to the solenoid coil, whereby the attracted state is maintained for a predetermined time period following completion of activation of the solenoid valve, and thereafter, transition to the second period is carried out (refer to the one-dot-dash line of FIG. 2B).

Stated otherwise, in the conventional art, even if there is no fear of the attracted state being released during the first period, the current continues to flow in the solenoid coil inadvertently. Thus, the length of the first period becomes longer and the activation current value also becomes larger, so that electrical energy tends to be consumed needlessly.

Consequently, with the present invention, by constructing the solenoid valve driving circuit in the following manner, lower power consumption during the first period can be realized.

More specifically, the maintaining state transition determining unit is capable of selecting, as a transition timing from among the first period to the second period, any time between first to fourth times, consisting of a first time after start of applying the first voltage with respect to the solenoid coil and when the rate of change over time becomes substantially zero, a second time after the first time and when a current value of the current has decreased, a third time after the second time and when the current value has increased to the current value at the first time, and a fourth time after the third time and after the current value at the first time has been maintained.

Herein, the first time is defined as a time at which the movable core and the valve body start to be attracted to the iron core by the activation force after the current has increased rapidly over time immediately after start of application of the first voltage (i.e., a time at which the current reaches a maximum value) (time t1 of FIG. 3C). Further, the second time is defined as a time at which the current value decreases from the current value at the first time, in accordance with the movable core and the valve body becoming attracted to the iron core (each of times between the times t1 and t3 in FIG. 2C, and time t2 in FIG. 4C). Furthermore, the third time is defined as a time at which the current value again reaches the current value at the first time by continuously passing current for the purpose of maintaining the attracted state in recognition of the fear that the attracted state may be released (time t3 in FIG. 2C). Still further, the fourth time is defined as a time after the attracted state has been maintained while the current value is controlled so as not to exceed the current value at the first time, following the third time at which the current value has reached the current value at the first time (time t8 in FIG. 5C).

Accordingly, the maintaining state transition determining unit is capable of selecting, as a transition timing from the first period to the second period, any of the times from the first time to the fourth time. As a result, compared to the conventional technique, flexibility in design can be achieved. Furthermore, since the first period can be shortened together with minimizing the activation current value, inadvertent supply of electrical energy needlessly with respect to the solenoid coil can be avoided, and lower consumption of power during the first period can be realized.

For example, in the case that the first time is selected, subsequent to the first time, because attraction is initiated and then the current value decreases, upon completion of attraction, the solenoid valve can transition to the maintained state smoothly. Further, in the case that the second time is selected as well, upon completion of attraction, the solenoid valve can transition to the maintained state smoothly. Furthermore, in the case that the third time is selected, since the solenoid valve can transition to the maintained state only after completion of attraction has been confirmed, any fear that the attracted state could become released can be avoided. Still further, in the case that the fourth time is selected, because the solenoid valve transitions to the maintained state after the attracted state has been maintained without causing the current to be made large in value, releasing of the attracted state can reliably be avoided. Accordingly, within the time band from the first time to the fourth time, if the third time is selected in particular, low power consumption of the solenoid valve can be achieved, together with avoiding release of the attracted state.

In addition, the solenoid valve driving circuit includes an activation current setting unit for setting the first period longer such that the activation current value, which is a maximum value of the current during the first period, becomes large, together with a usage limit determining unit for determining whether or not the activation current value exceeds a current threshold, and for externally notifying that the solenoid valve has reached its usage limit in the event that the activation current value exceeds the current threshold.

When the solenoid valve is used over a long period, a response delay is generated in activation of the solenoid valve. Accordingly, an increase in the activation current value is carried out in order to compensate for the response delay. Notwithstanding, if the activation current value becomes greater than the threshold current value, it becomes difficult to ensure responsiveness and low power consumption of the solenoid valve. With the present invention, the usage limit determining unit externally notifies the usage limit, and thus a user can confirm easily that the solenoid valve has reached the usage limit (lifespan).

Further, the usage limit determining unit may determine whether or not the first period is longer than a time period threshold, and externally notify that the solenoid valve has reached its usage limit in the case that the first period is longer than the time period threshold.

In this case as well, if the first period is longer than the time period threshold, it becomes difficult to assure responsiveness of the solenoid valve. Thus, by notifying the usage limit to the exterior, a user can confirm easily that the solenoid valve has reached the usage limit (lifespan).

In this manner, by equipping the solenoid valve driving circuit and the solenoid valve with the usage limit determining unit, a self-diagnosing capability is provided for the solenoid valve. Thus, reliability of the solenoid valve driving circuit and the solenoid valve can be further enhanced.

The solenoid valve driving circuit may further be equipped with a switching unit for applying the first voltage to the solenoid coil by being turned ON during the first period, and for applying the second voltage to the solenoid coil by being turned ON during the second period, and a switch controller comprising the rate of change over time calculating unit and the maintaining state transition determining unit, for controlling ON and OFF states of the switching unit.

Owing thereto, low power consumption of the solenoid valve can easily be realized.

In this case, the switch controller may be equipped with a control signal supplying unit for supplying a first control signal to the switching unit during the first period to turn ON the switching unit, and for supplying a second control signal to the switching unit during the second period to turn the switching unit either ON or OFF based on the transition from the first period to the second period determined by the maintaining state transition determining unit.

Further, the solenoid coil may be connected electrically to a power source via the solenoid valve driving circuit. A power source voltage of the power source may be applied as the first voltage from the power source to the solenoid coil via the solenoid valve driving circuit by turning ON the switching unit during the first period, and a power source voltage of the power source may be applied as the second voltage from the power source to the solenoid coil via the solenoid valve driving circuit by turning ON the switching unit during the second period.

In the foregoing manner, because the switch controller and the switch serve to adjust the first period and the second period based on detection of the current, the present invention can easily be applied to pre-existing solenoid valve driving circuits and solenoid valves.

Further, the solenoid valve driving circuit may additionally include a light emitting diode connected electrically between the power source and the switch controller, and which emits light when the power source applies the power source voltage to the switch controller.

Owing thereto, during operation of the solenoid valve, the light emitting diode emits light. Thus, a user can easily grasp that the solenoid valve is under operation by visually confirming the light from the light emitting diode.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A solenoid valve driving circuit and a solenoid valve according to the present invention shall be described in detail below with reference to the accompanying drawings, while presenting a preferred embodiment thereof in relation to a driving method for the solenoid valve.

Figure 1:
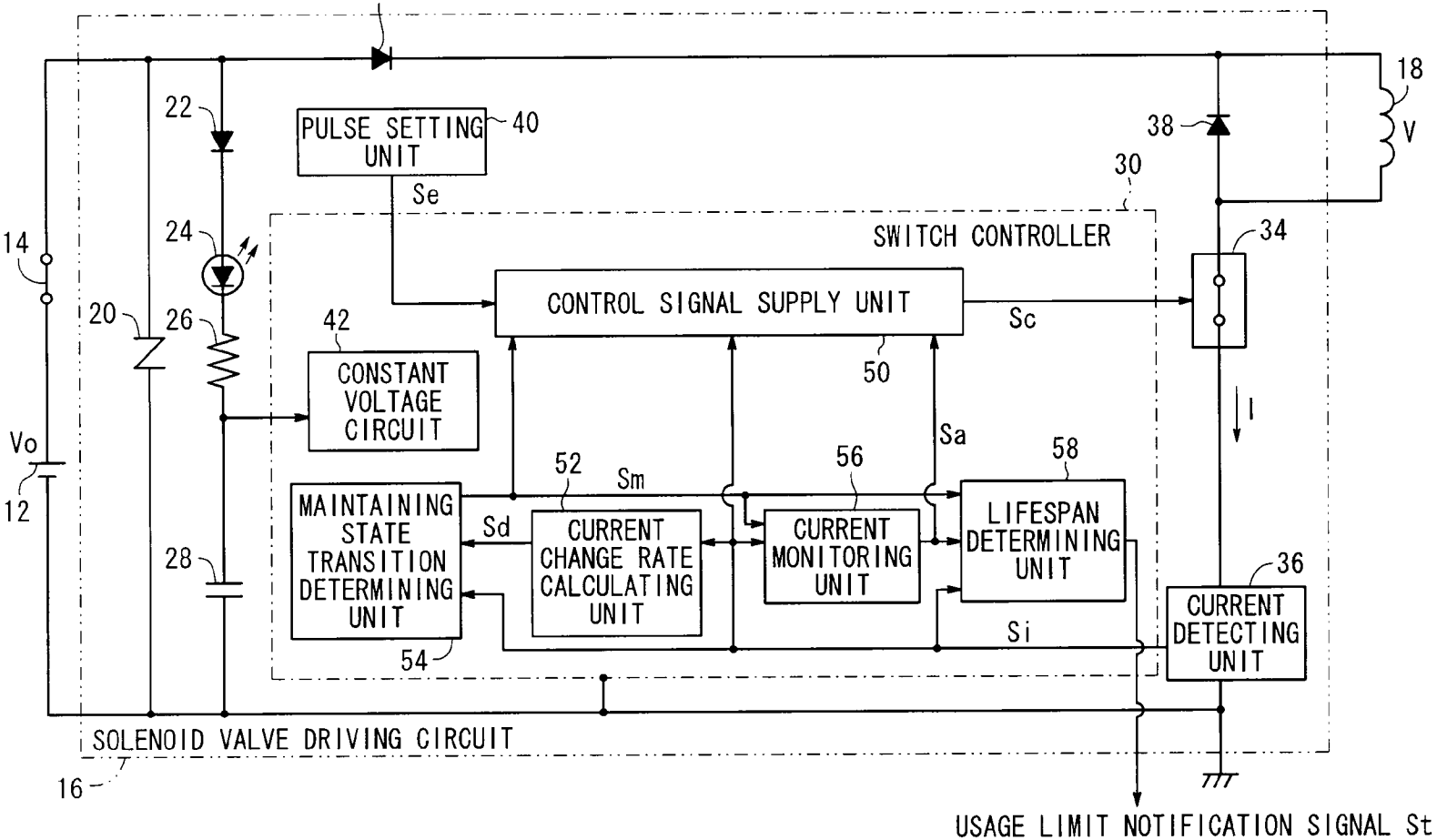
FIG. 1 is a circuit diagram of a solenoid valve driving circuit and a solenoid valve according to a present embodiment.

As shown in FIG. 1, a solenoid valve 10 according to the present embodiment includes a solenoid valve driving circuit 16 and a solenoid coil 18, which are connected electrically and respectively in parallel with respect to a DC power source 12 via a switch 14. In this case, a positive terminal of the DC power source 12 is connected electrically to one end of the solenoid coil 18 via the switch 14 and a positive terminal side of the solenoid valve driving circuit 16, whereas a negative terminal of the DC power source 12 is connected to ground together with the negative terminal side of the solenoid valve driving circuit 16 and the other end of the solenoid coil 18.

In the solenoid valve driving circuit 16, a surge absorber 20, a series circuit made up of a diode 22, a light emitting diode (LED) 24, a resistor 26 and a capacitor 28, and another series circuit made up of a diode 32, the solenoid coil 18, a switching unit 34 and a current detector 36, are connected electrically in parallel with respect to a series circuit made up of the DC power source 12 and the switch 14.

Further, the capacitor 28 is connected electrically in parallel with a switch controller 30, whereas a diode 38 is connected electrically in parallel to the solenoid coil 18. Further, the solenoid valve driving circuit 16 additionally includes a pulse setting unit 40.

The switch controller 30 comprises a constant voltage circuit 42, a control signal supply unit 50, a current change rate calculating unit (rate of change over time calculating unit) 52, a maintaining state transition determining unit 54, a current monitoring unit (activation current setting unit) 56, and a lifespan determining unit (usage limit determining unit) 58.

Next, respective structural elements of the solenoid valve 10 shall be described in detail.

Figures 2A, 2B, 2C, 2D, 2E:
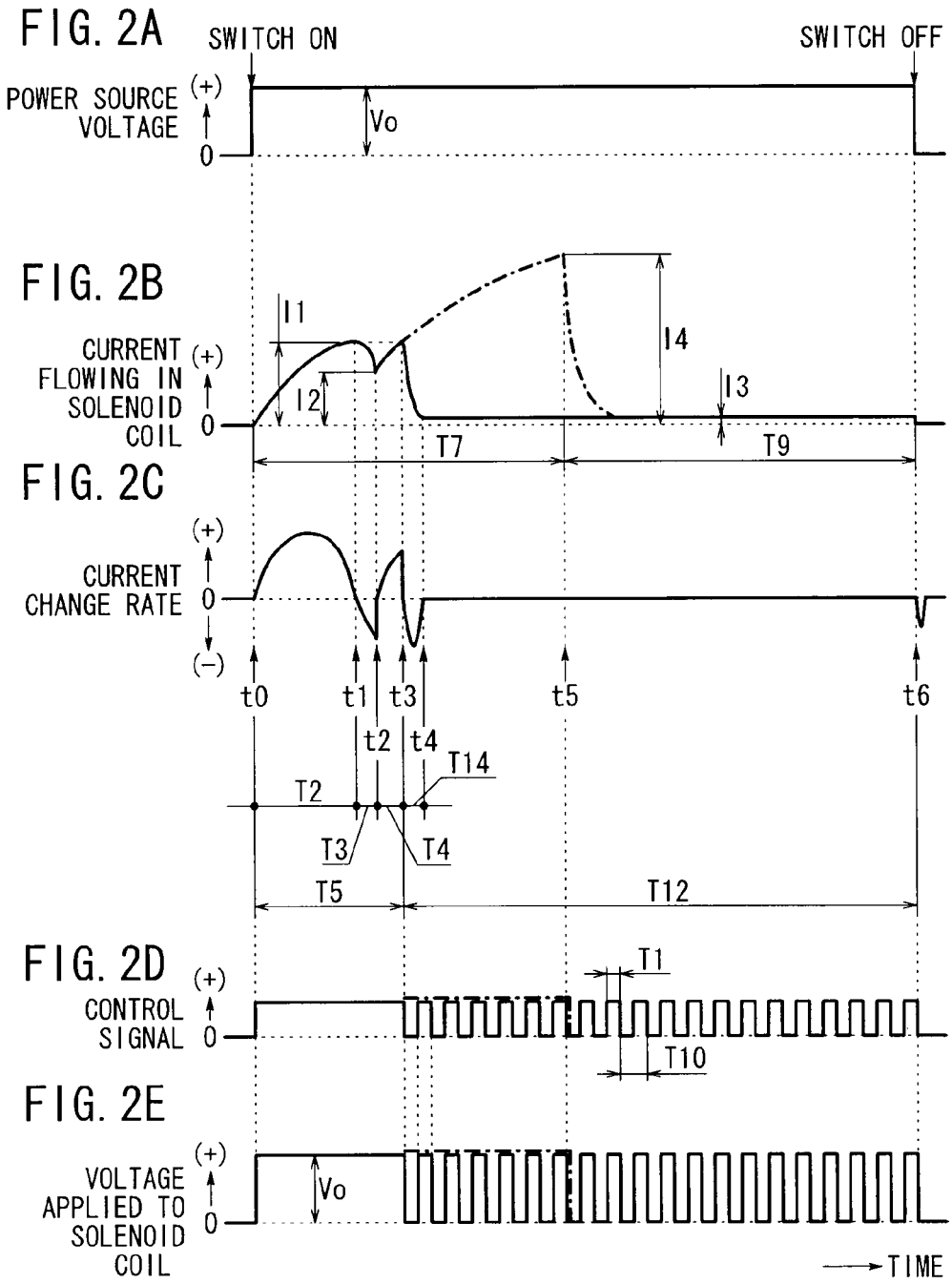
FIG. 2A is a time chart of a power source voltage.
FIG. 2B is a time chart of a current that flows in a solenoid coil.
FIG. 2C is a time chart of a rate of change over time of the current.
FIG. 2D is a time chart of a control signal output from a control signal supply unit.
FIG. 2E is a time chart of a voltage applied to the solenoid coil.

The surge absorber 20 serves as a voltage dependent resistor for circuit protection, in which, upon opening and closing of the switch 14 (i.e., at a time t0 (switch ON), which is an activation time of the solenoid valve 10, or at a time t6 (switch OFF) which is a shutdown time, as shown in FIGS. 2A and 2C), a resistance value of the surge absorber 20 is lowered instantaneously in response to a surge voltage generated momentarily in the solenoid valve driving circuit 16, so that a surge current caused by the surge voltage, which flows in the solenoid valve driving circuit 16, is rapidly discharged to ground. The surge voltage is defined as a voltage, which is larger than the power source voltage V0 of the DC power source 12.

The diode 32 serves as a circuit protective diode for preventing current from flowing from the solenoid coil 18 toward the positive terminal of the DC power source 12 via the diode 32. The diode 22 serves as a circuit protective diode for preventing current from flowing from the LED 24 toward the positive terminal of the DC power source 12 via the diode 22. Further, the diode 38 serves as a diode that causes a current due to a back electromotive force (back EMF) generated in the solenoid coil 18 during shutdown (time t6) of the solenoid valve 10 to circulate back in a closed circuit path made up of the solenoid coil 18 and the diode 38, in order for the current to be rapidly attenuated.

The LED 24, at a time when the switch 14 is in an ON state (i.e., during operation of the solenoid valve 10 from time t0 to time t6 shown in FIG. 2C), emits light in response to current that flows from the diode 22 toward the resistor 26, whereby notification is made externally that the solenoid valve 10 is currently in operation.

The resistor 26 serves as an inrush current limiting resistor, for regulating an inrush current flowing into the switch controller 30 such that the inrush current drops below the rated value (rated current) of the current I that flows through the solenoid coil 18 when the switch 14 is turned ON. Accordingly, by carrying out such a countermeasure to the inrush current, the resistor 26 functions as a resistor that prevents malfunctioning of the solenoid valve driving circuit 16 and the solenoid valve 10 caused by the surge voltage, which is generated in the solenoid valve driving circuit 16 upon activation and shutdown of the solenoid valve 10.

The capacitor 28, by changing the capacitance thereof, serves as a capacitor capable of adjusting the instantaneous interruption time of the solenoid valve driving circuit 16 including the switch controller 30, and also functions as a bypass capacitor for discharging to ground high frequency components, which are included in the current flowing from the resistor 26 to the constant voltage circuit 42.

Upon supply thereto of a control signal Sc (a first control signal or a second control signal) supplied from the switch controller 30, the switching unit 34 is turned ON, and by establishing conduction (continuity) between the solenoid coil 18 and the current detector 36, the power source voltage V0 from the DC power source 12 is applied to the solenoid coil 18 as an applied voltage V (first voltage or second voltage) with respect to the solenoid coil 18. Further, when supply of the control signal Sc is stopped, the switching unit 34 is turned OFF, and by interrupting conduction between the solenoid coil 18 and the current detector 36, application of the applied voltage V with respect to the solenoid coil 18 is suspended. As the switching unit 34, a semiconductor switching element such as a transistor, an FET (Field Effect Transistor), a MOSFET (Metal Oxide Semiconductor Field Effect Transistor) or the like, which are capable of carrying out ON and OFF switching operations in a short time responsive to the control signal Sc, may be applied advantageously.

The current detector 36 sequentially detects the current I that flows through the current detector 36 from the solenoid coil 18 via the switching unit 34, whereupon the current value and direction of the detected current I are output sequentially as a detection signal Si to the switch controller 30. As a detection technique for detecting the current I by the current detector 36, for example, there may be adopted any of well known current detection techniques, such as a resistance detection technique, in which a voltage generated by a resistor connected electrically in series with the switching unit 34 is detected, or a non-contact detection technique, in which a magnetic field generated when the current I flows along a conductive wire from the switching unit 34 to ground is detected using a Hall element, etc.

In the pulse setting unit 40, initial values for the pulse width, duty ratio and repetition period of the control signal Sc produced by the control signal supply unit 50 are set or adjusted beforehand. As the pulse setting unit 40, preferably, operating buttons may be disposed on the casing of the solenoid valve 10, which enable settings or adjustments to be made by the user. Alternatively, a memory may be provided in which the aforementioned pulse width, duty ratio and repetition period are stored beforehand, and which are recalled as needed and set in the control signal supply unit 50.

The constant voltage circuit 42 of the switch controller 30 converts the power source voltage V0, which has been supplied from the DC power source 12 via the switch 14, the diode 22, the LED 24 and the resistor 26, into a constant level DC voltage, and supplies the same to each of the components in the switch controller 30.

The current change rate calculating unit 52 calculates a rate of change over time of the current I (refer to FIGS. 2C, 3C, 4C and 5C) based on the detection signal Si supplied sequentially from the current detector 36, and then outputs a calculation signal Sd indicative of the calculated rate of change over time to the maintaining state transition determining unit 54.

Incidentally, during the first period that serves as the activation time for the solenoid valve 10 (e.g., the time interval T5 from time t0 to time t3 in FIG. 2C, or the time interval T7 from time t0 to time t5), as described later, the current I that flows through the solenoid coil 18 increases rapidly over time, immediately following start of application of the voltage V (power source voltage V0) (see FIG. 2B). In this case, when a magnetomotive force (activation force) caused by the current I is imposed on the movable core (plunger) and the valve body installed on the end of the plunger (not shown) that make up the solenoid valve 10, the movable core is attracted to the fixed core (iron core) by the activation force, and together with the passage of time, the increased current I decreases slightly in value (over the time interval T3 from time t1 to time t2 in FIGS. 2B and 2C). More specifically, concerning the current I, which has increased in value immediately following start of application of the voltage V, the current value thereof obtains a maximum value (activation current value I1 at time t1) immediately prior to initiation of an attraction operation, caused by imposition of the activation force with respect to the plunger and the valve body. Then, as a result of the plunger and the valve body starting to be attracted to the iron core, the current value begins to decrease. Then, upon attraction of the plunger and the valve body to the iron core, activation of the solenoid valve 10 is brought to an end.

However, in the conventional art, based on a fear that the movable core and the valve body, having once been attracted thereto, may separate away from the iron core and thus release the attracted state, in terms of design, the current I continues to be applied to the solenoid coil 18, and the attracted state is maintained for a predetermined time period following completion of activation of the solenoid valve. Thereafter, a transition to the second period serving as a maintaining time period, during which the driven state of the solenoid valve 10 is maintained, is carried out (refer to the one-dot-dash line of FIG. 2B).

Stated otherwise, in the conventional art, during the first period, because the current I continues to flow through the solenoid coil 18 inadvertently even if there is no fear of the attracted state becoming released, the first period becomes longer, and together therewith, the activation current value becomes greater (i.e., together with the first period becoming the time interval T7 from time t0 to time t5, the activation current reaches the value I4, which is the maximum value of the curve shown by the one-dot-dash line), whereby electrical energy is consumed needlessly. Further, conventionally, as described above, the time interval T7 from time t0 to time t5 serves as the first period, whereas the time interval T9 from time t5 to time t6 serves as the second period.

Figures 3A, 3B, 3C, 3D, 3E:
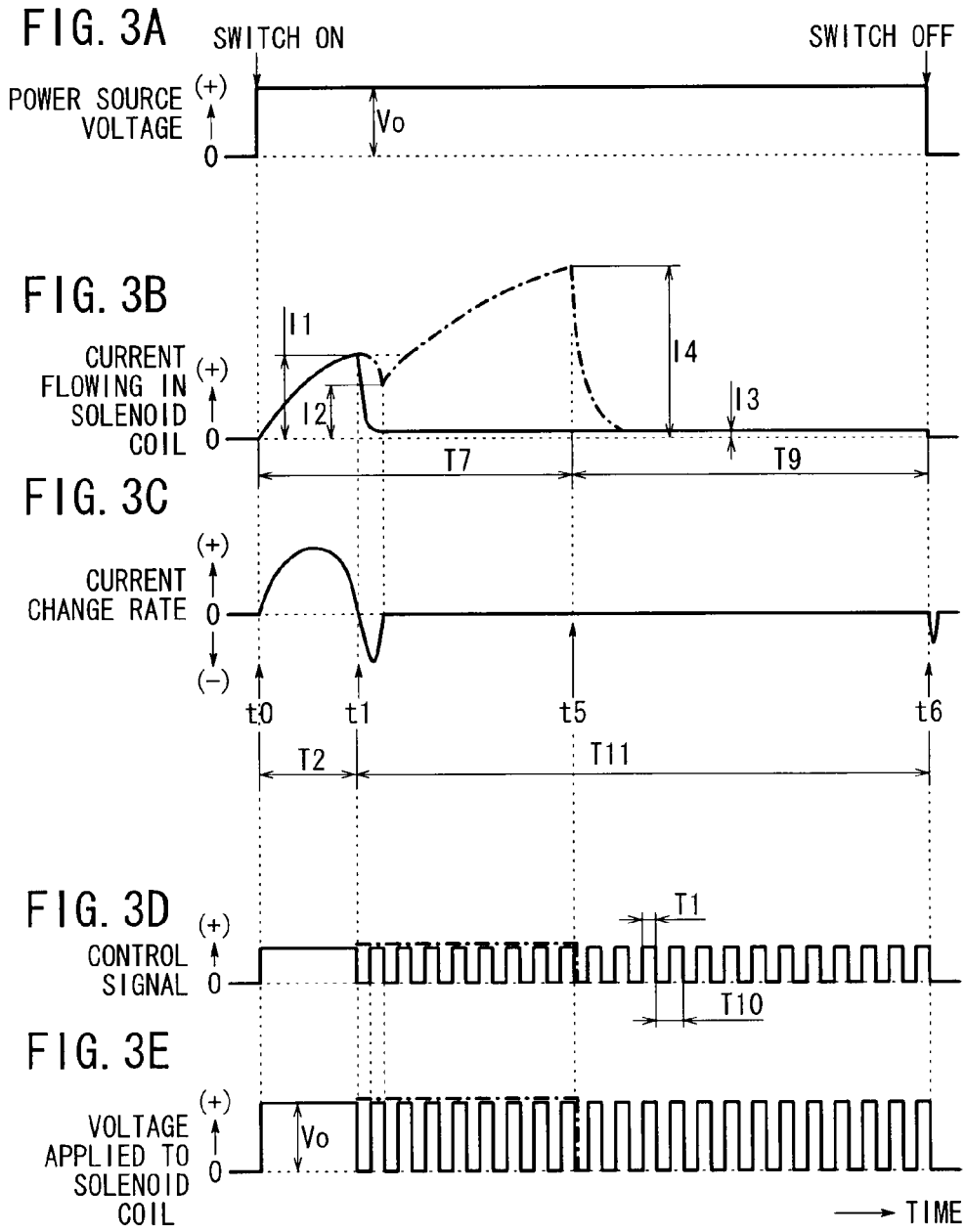
FIG. 3A is a time chart of a power source voltage.
FIG. 3B is a time chart of a current that flows in a solenoid coil.
FIG. 3C is a time chart of a rate of change over time of the current.
FIG. 3D is a time chart of a control signal output from a control signal supply unit.
FIG. 3E is a time chart of a voltage applied to the solenoid coil.
Figures 4A, 4B, 4C, 4D, 4E:
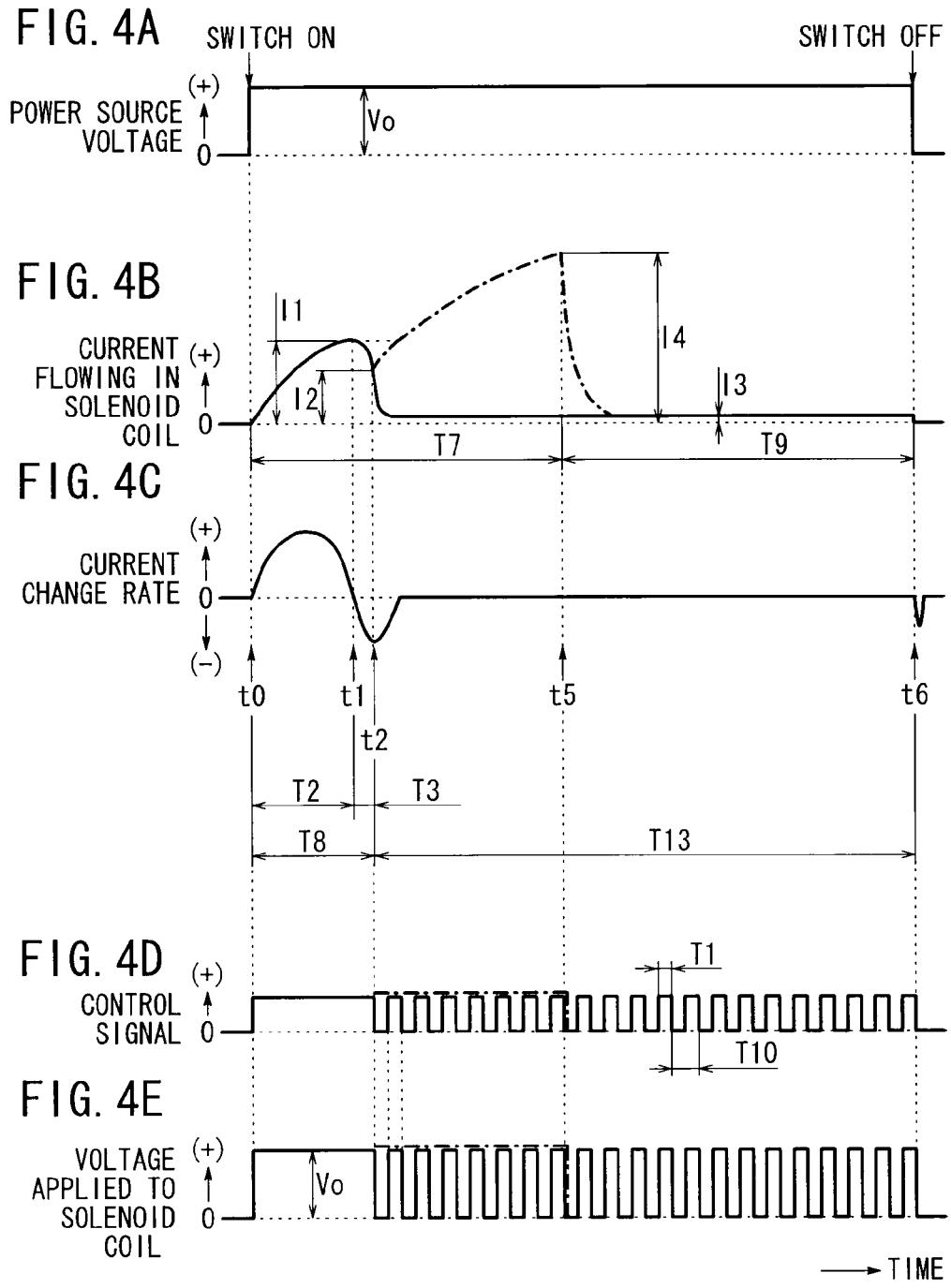
FIG. 4A is a time chart of a power source voltage.
FIG. 4B is a time chart of a current that flows in a solenoid coil.
FIG. 4C is a time chart of a rate of change over time of the current.
FIG. 4D is a time chart of a control signal output from a control signal supply unit.
FIG. 4E is a time chart of a voltage applied to the solenoid coil.
Figures 5A, 5B, 5C, 5D, 5E:
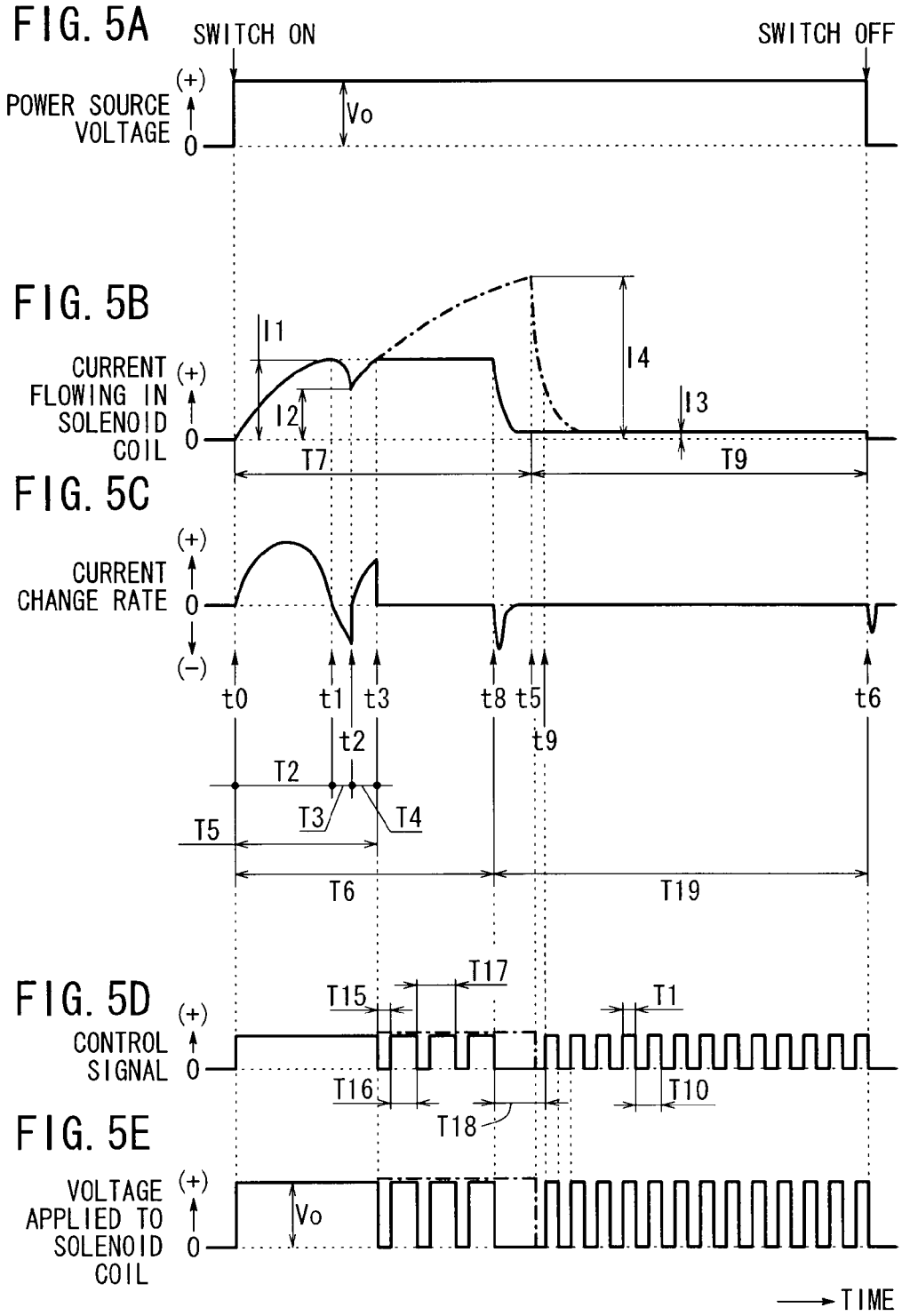
FIG. 5A is a time chart of a power source voltage.
FIG. 5B is a time chart of a current that flows in a solenoid coil.
FIG. 5C is a time chart of a rate of change over time of the current.
FIG. 5D is a time chart of a control signal output from a control signal supply unit.
FIG. 5E is a time chart of a voltage applied to the solenoid coil.

Consequently, in the present embodiment, the maintaining state transition determining unit 54 determines a timing at which a transition occurs from the first period, which serves as a time period during which the solenoid valve 10 is activated (i.e., the time interval T5 (T5=T2+T3+T4) of FIG. 2C, the time interval T2 of FIG. 3C, the time interval T8 (T8=T2+T3) of FIG. 4C, or the time interval T6 of FIG. 5C), to the second period, which serves as a time period during which the solenoid valve 10 is maintained (i.e., the time interval T12 of FIG. 2C, the time interval T11 of FIG. 3C, the time interval T13 of FIG. 4C, or the time interval T19 of FIG. 5C), based on the calculation signal Sd supplied from the current change rate calculating unit 52 and the detection signal Si supplied from the current detector 36.

Stated otherwise, in the present embodiment, for the timing at which transitioning occurs from the first period to the second period, any time can be selected between time t1 (first time) when the time interval T2 has elapsed since time t0, and time t8 (fourth time) when the time interval T6 has elapsed since time t0.

More specifically, the maintaining state transition determining unit 54 is capable of selecting, as the transition timing, any time from among the following times (1) to (4) described below.

(1) A time t1 (first time), at which the rate of change over time of the current I becomes zero after start of application of the voltage V (at time t0) with respect to the solenoid coil 18, may be selected as the aforementioned timing (see FIGS. 3B and 3C). Such a time t1 represents a time at which the plunger and the valve body start to be attracted to the iron core, and since, following the first time, attraction is started and the current value decreases, such attraction is completed, and thus the solenoid valve transitions to the maintained state smoothly. In this case, the time interval T2 from time t0 to time t1 becomes the first period, and the time interval T11 from time t1 to time t6 becomes the second period.

(2) A time, at which the current value of the current I has decreased after time t1 (the second time, any time between time t1 to time t2), may be selected as the aforementioned timing (see FIGS. 4B and 4C). Such a time represents a time during which an attraction operation of the plunger and the valve body to the iron core is being carried out, or when the attraction has been completed. In this case as well, together with completion of such attraction, the solenoid valve transitions to the maintained state smoothly. For example, in the case of FIGS. 4B and 4C, the time interval T8 from time t0 to time t2 becomes the first period, and the time interval T13 from time t2 to time t6 becomes the second period.

(3) A time t3 (third time), at which the current value rises again to the current value at time t1, may be selected as the aforementioned timing (see FIGS. 2B and 2C). Such a time t3 represents a time at which attraction has already been completed, and thus after completion of such attraction has been confirmed, the solenoid valve transitions to the maintained state. In this case, the time interval T5 from time t0 to time t3 becomes the first period, and the time interval T12 from time t3 to time t6 becomes the second period.

(4) A time t8 (fourth time) after the current I has been maintained at the current value of time t1 since time t3 by supply of the control signal Sc to the switching unit 34 from the control signal supply unit 50, may be selected as the aforementioned timing (see FIGS. 5B and 5C). Such a time t8 represents a time at which attraction has already been completed, and since the attracted state is retained sufficiently, the solenoid valve transitions to the maintained state after retention of the attracted state is confirmed. In this case, the time interval T6 from time t0 to time t8 becomes the first period, and the time interval T19 from time t8 to time t6 becomes the second period.

In addition, the maintaining state transition determining unit 54 outputs a judgment signal Sm indicative of the determined timing to the control signal supply unit 50, the current monitoring unit 56, and the lifespan determining unit 58.

Returning again to FIG. 1, the control signal supply unit 50 is equipped with an oscillator, a single pulse generating circuit, a repeating pulse generating circuit, and a pulse supplying unit, as disclosed in Japanese Patent No. 4359855. Based on the judgment signal Sm from the maintaining state transition determining unit 54, in accordance with a PWM control, a pulse having a pulse width or a duty ratio and repetition period corresponding to the current value and the current change rate of the current I that flows through the solenoid coil 18 is supplied as a control signal Sc to the switching unit 34. Stated otherwise, in the event that the judgment signal Sm is input thereto, the control signal supply unit 50 ignores the initial values of the pulse width, duty ratio and repetition period set by the pulse setting unit 40, and generates a pulse corresponding to the current value and current change rate of the current I. Then, the generated pulse is supplied as a control signal Sc to the switching unit 34.

In greater detail, in the case of the aforementioned situations (1) to (3), until the judgment signal Sm is input, the control signal supply unit 50 supplies a single pulse of a predetermined signal level to the switching unit 34. However, when the judgment signal Sm is input at time t3 in FIG. 2C, time t1 in FIG. 3C, or time t2 in FIG. 4C, supply of the single pulse is stopped immediately, and a repetitive pulse having a pulse width of time interval T1 and a repetition period of time interval T10 is supplied continuously to the switching unit 34 until time t6.

More specifically, during the first period until the judgment signal Sm is input, the control signal supply unit 50 supplies as a first control signal Sc to the switching unit 34 a single pulse having a pulse width of the time interval T5 of FIG. 2C, the time interval T2 of FIG. 3C, or the time interval T8 of FIG. 4C. On the other hand, during the second period after the judgment signal Sm is input, the control signal supply unit 50 supplies as a second control signal Sc to the switching unit 34 a repetitive pulse having a pulse width of time interval T1 and a repetition period of time interval T10.

Further, in the case of the aforementioned situation (4), during the first period until the judgment signal Sm is input thereto, after the control signal supply unit 50 has supplied to the switching unit 34 a single pulse having a pulse width of the time interval T5 from time t0 to time t3, the control signal supply unit 50 supplies to the switching unit 34 a repetitive pulse having a pulse separation of the time interval T15 (e.g., T15=T1), a pulse width of the time interval T16 (e.g., T16>T1), and a repetition period of the time interval T17 (T17=T15+T16). Furthermore, during the second period after the judgment signal Sm has been input, after a time interval T18 (pulse rest interval) from time t8 to time t9, the control signal supply unit 50 supplies to the switching unit 34 a repetitive pulse having a pulse width of the time interval T1 and a repetition period of the time interval T10.

In this manner, by input thereto of the judgment signal Sm, the control signal supply unit 50 regulates the pulse width, etc., of the control signal Sc during the first period, while also regulating the pulse width, etc., of the control signal Sc during the second period. Thus, substantially during the operation period of the solenoid valve 10 from time t0 to time t6, inclusive of the first period and the second period, pulses corresponding to the current value and current change rate of the current I are supplied as control signals Sc to the switching unit 34, thereby controlling ON and OFF states of the switching unit 34.

Figure 6A:
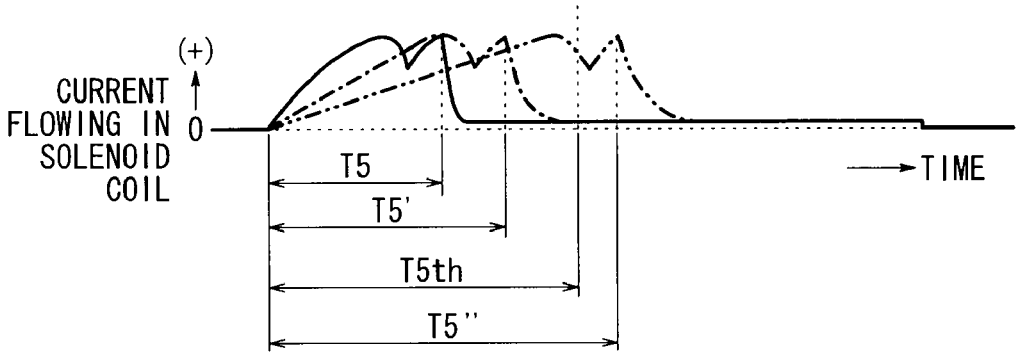
FIG. 6A is a time chart showing a time delay (response delay) of current that flows in the solenoid coil.

Incidentally, when the solenoid valve 10 is used over a long period, a response delay in activation of the solenoid valve 10 is generated (see FIG. 6A).

Consequently, the current monitoring unit 56 monitors the current value of the current I indicated by the detection signal Si supplied from the current detector 36, and judges that the response delay of the solenoid valve 10 has been generated. More specifically, in the case that the first period, which defines the activation time, becomes longer (T5→T5'), it is determined that a response delay of the solenoid valve 10 has been generated, whereupon an instruction signal Sa for instructing that the first period be set longer (T5'→T5*a*') so that the activation current value I1 is increased (I1→I1') is output to the control signal supply unit 50 and the lifespan determining unit 58. Then, when the instruction signal Sa is input thereto, during the first period, the control signal supply unit 50 outputs as a control signal Sc to the switching unit 34 a single pulse of a longer pulse width. Further, in the case of the aforementioned situation (4), during the first period, the control signal supply unit 50 sets the pulse width of the single pulse and the pulse width of the repetitive pulse longer, respectively, and supplies the respective pulses to the switching unit 34.

In the case that the current value I" of the current I indicated by the detection signal Si supplied from the current detector 36 is greater than a predetermined current threshold Ith (I1">Ith in FIG. 6B), or in the case that the length T5" of the first period determined by the maintaining state transition determining unit 54 (the length T5" of the first period indicated by the instruction signal Sa) is longer than a predetermined period threshold T5*th* (T5">T5*th* in FIGS. 6A and 6B), the lifespan determining unit 58 externally outputs a usage limit notification signal St, which indicates that the usage limit (lifespan) of the solenoid valve 10 has been reached.

Figure 6B:
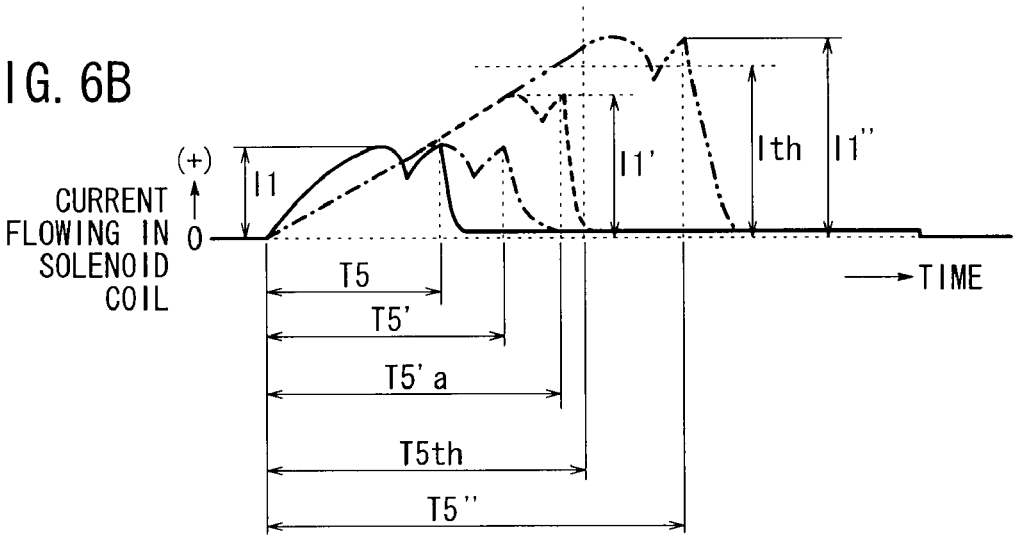
FIG. 6B is a time chart showing a case in which an activation current value is increased in order to compensate for the response delay of FIG. 6A.

In FIGS. 6A and 6B, as one example, a case has been explained in which the transition timing from the first period to the second period is taken as the time t3 of FIG. 2C (i.e., the length of the first period is the interval T5). However, the present invention is not limited to this description, and it is a matter of course that the invention can be applied in the cases of FIGS. 3A to 5E as well.

The solenoid valve driving circuit 16 and the solenoid valve 10 according to the present embodiment are constructed basically as described above. Next, with reference to FIGS. 1 through 6B, explanation shall be made concerning operations (solenoid valve driving method) of the solenoid valve driving circuit 16 and the solenoid valve 10.

Herein, an explanation shall be given in which, in the case that the judgment signal Sm is not input, during the first period, the control signal supply unit 50 supplies to the switching unit 34 a single pulse having a pulse width (time interval T7) set by the pulse setting unit 40, and thereafter, during the second period, generates a pulse signal Sr having a duty ratio T1/T10 (i.e., a pulse width of interval T1 and a repetition period of interval T10) set by the pulse setting unit 40.

Further, an explanation shall also be given in which, as in situation (3) above, in the case that transitioning from the first period to the second period occurs at the timing of time t3, a judgment signal Sm is output from the maintaining state transition determining unit 54 to the control signal supply unit 50, the current monitoring unit 56, and the lifespan determining unit 58.

At time t0, when the switch 14 is closed and is turned ON (see FIG. 2A), a power source voltage V0 is supplied from the DC power source 12 to the constant voltage circuit 42 via the diode 22, the LED 24 and the resistor 26. The LED 24 is illuminated in response to the current that flows from the diode 22 toward the resistor 26, whereby it is notified to the exterior that the solenoid valve 10 is currently in operation. The constant voltage circuit 42 converts the power source voltage V0 into a predetermined DC voltage, and supplies the same to each of the components in the switch controller 30.

Because the judgment signal Sm is not input thereto, the control signal supply unit 50 supplies a control signal Sc (single pulse) of a predetermined signal level to the switching unit 34 (see FIG. 2D).

Owing thereto, the switching unit 34 is turned ON based on the control signal Sc, and since the solenoid coil 18 and the current detector 36 are connected electrically (i.e., conductivity exists therebetween), the power source voltage V0 is applied as a first voltage V from the DC power source 12 to the solenoid coil 18 via the switch 14 and the diode 32 (see FIG. 2E). As a result, the current I, which flows from the solenoid coil 18 in the direction of the current detector 36 via the switching unit 34, increases rapidly in value over time (see FIG. 2B).

The current detector 36 sequentially detects the current I, and sequentially outputs a detection signal Si indicative of the detected current I to the control signal supply unit 50, the current change rate calculating unit 52, the maintaining state transition determining unit 54, the current monitoring unit 56, and the lifespan determining unit 58.

The current change rate calculating unit 52 calculates a rate of change over time of the current I indicated by the detection signal Si (see FIG. 2C), and outputs a calculation signal Sd indicating the calculated rate of change over time to the maintaining state transition determining unit 54.

Incidentally, when the current I starts to flow through the solenoid coil, the plunger and the valve body of the solenoid valve 10 are urged by an activation force caused by the current I.

At time t1, i.e., when the time interval T2 has elapsed since time t0, the current value attains a maximum value (activation current value I1), whereupon attraction of the plunger and the valve body to the iron core is initiated and the current value begins to decrease. Additionally, at time t2, i.e., when the time interval T3 has elapsed since time t1 and the current has decreased to the current value I2, the plunger and the valve body has been attracted to the iron core and activation of the solenoid valve 10 is completed.

In this case, since the current value increases over time in the interval T2, the rate of change over time of the current I is a positive value. At time t1, the rate of change of the current value becomes zero, and thereafter, over the time span of the activation operation (time interval T3), because the current value decreases, the rate of change over time of the current I becomes a negative value.

After time t2, by supply of the control signal Sc with respect to the switching unit 34, the switching unit 34 is retained in an ON state, whereupon the current value of the current I that flows through the solenoid coil 18 increases over time from the current value I2.

At time t3, i.e., when the time interval T4 has elapsed since time t2, when the current value again reaches the activation current value I1, the maintaining state transition determining unit 54 judges that activation of the solenoid valve 10 has been completed and there is no fear of the plunger and the valve body becoming separated from the iron core, together with judging that energy savings cannot be obtained in the first period if the first period were made any longer. Accordingly, the maintaining state transition determining unit 54 determines time t3 as the transition timing for transitioning from the first period to the second period.

In addition, the maintaining state transition determining unit 54 supplies a judgment signal Sm indicative of the determined timing (time t3) to the control signal supply unit 50, the current monitoring unit 56, and the lifespan determining unit 58.

The control signal supply unit 50, in accordance with input of the judgment signal Sm, recognizes the transition from the first period to the second period, and immediately stops generation of the single pulse at the predetermined level. Accordingly, during the first period, the control signal supply unit 50 supplies the single pulse having a pulse width of the time interval T5 from time t0 to time t3 to the switching unit 34. Subsequently, during the second period, the control signal supply unit 50 supplies to the switching unit 34 a repetitive pulse (control signal Sc) having a pulse width of the time period T1 and a repetition period of the time interval T10. As a result, in accordance with the repetitive pulse, the switching unit 34 is turned ON and OFF repeatedly between time t3 and time t6.

Accordingly, during the second period, the power source voltage V0 is applied repeatedly from the DC power source 12 as the second voltage V to the solenoid coil 18 via the switch 14 and the diode 32 (see FIG. 2E), and the current I that flows from the solenoid coil 18 to the current detector 36 via the switching unit 34, after decreasing rapidly in a short time (time interval T14 from time t3 to time t4) from the activation current value I1 to the maintenance current value I3, is maintained at the maintenance current value I3 until time t6 (see FIG. 2B). As a result, by means of the magnetomotive force (holding force) caused by the maintenance current value I3, the plunger and the valve body are maintained at a predetermined position, and the driven state (valve open state) of the solenoid valve 10 is maintained.

On the other hand, the rate of change over time of the current I changes abruptly from a negative value to a positive value and increases immediately after time t2, and then from time t3 to time t4, changes rapidly again to a negative value, becoming substantially zero from time t4 to time t6. In the present embodiment, because the rate of change over time of the current I is calculated in order to determine the transition timing from the first period to the second period, the rate of change over time after time t3 at which transition to the second period has occurred, is not utilized in particular.

Additionally, when the switch 14 is turned OFF at time t6 (see FIG. 2A), because supply of the power source voltage V0 to the switch controller 30 is suspended, the switch controller 30 overall is placed in a suspended state, and supply of the control signal Sc to the switching unit 34 from the switch controller 30 also is suspended. Owing thereto, the switching unit 34 is switched from ON to OFF, and application of the power source voltage V0 (voltage V) to the solenoid coil 18 from the DC power source 12 is suspended. In this case, although a back EMF is generated in the solenoid coil 18, the current caused by such a back EMF is quickly attenuated as a result of the circulation in the closed circuit made up from the solenoid coil 18 and the diode 38. Further, at time t6, because the current value of the current I becomes zero, the rate of change over time of the current I abruptly changes once to a negative value, and it then quickly returns to the zero level.

In place of the operations in the aforementioned situation (3), in the case that driving of the solenoid valve 10 is controlled according to situation (1), the maintaining state transition determining unit 54 determines time t1 as the timing for transitioning from the first period to the second period, and outputs a judgment signal Sm indicative of the determined timing. As a result, the first period becomes the time interval T2, and the second period becomes the time interval T11. Accordingly, the pulse width of the single pulse during the first period also becomes the time interval T2 (see FIGS. 3A to 3E).

Further, in place of the operations in the aforementioned situation (3), in the case that driving of the solenoid valve 10 is controlled according to situation (2), the maintaining state transition determining unit 54 determines time t2 as the timing for transitioning from the first period to the second period, and outputs a judgment signal Sm indicative of the determined timing. As a result, the first period becomes the time interval T8, and the second period becomes the time interval T13. Accordingly, the pulse width of the single pulse during the first period also becomes the time interval T8 (see FIGS. 4A to 4E).

Further, in place of the operations in the aforementioned situation (3), in the case that driving of the solenoid valve 10 is controlled according to situation (4), the maintaining state transition determining unit 54 determines time t8 as the timing for transitioning from the first period to the second period, and outputs a judgment signal Sm indicative of the determined timing. As a result, the first period becomes the time interval T6, and the second period becomes the time interval T19. (See FIGS. 5A to 5E).

In the case of the aforementioned situation (4), in the first period, the control signal supply unit 50, after having supplied the single pulse having a pulse width of the time interval T5, supplies to the switching unit 34 a repetitive pulse having a pulse separation of the time interval T15 and a pulse width of the time interval T16 for one period (time interval T17). Thereafter, during the second period, supply of the control signal Sc is paused for a time interval T18 from time t8 to time t9, and next, for a time span from time t9 to time t6, a repetitive pulse of one period, which is the time interval T10, is supplied to the switching unit 34.

As described above, according to the present invention, current I that flows through the solenoid coil 18 is detected, the rate of change over time of the detected current I is calculated, and based on the calculated rate of change over time, a transition timing (times t1, t2, t3, t8) from the first period (time intervals T2, T5, T6, T8) to the second period (time intervals T11, T12, T13, T19) is determined. Therefore, the first period can be set to an optimal period corresponding to the specifications and conditions of the solenoid valve 10.

In this manner, by optimizing the first period, which corresponds to the activation time of the solenoid valve 10, the first period (activation time) can be shortened, and together therewith, the current value (activation current value) required for activating the solenoid valve 10 can be made smaller. As a result, lower power consumption during the first period can be realized.

Further, by enabling the timing at which the transition from the first period to the second period occurs to be determined, in the case that the operation time (an activation time of the solenoid valve 10 consisting of the total of the first period and the second period) of the solenoid valve 10 has been preset beforehand, if the first period becomes unusually long, it can be judged that the solenoid valve 10 is approaching its usage limit. More specifically, by recognizing the timing at which the transition from the first period to the second period occurs, self-diagnosis of when the solenoid valve 10 has reached its usage limit is enabled.

Accordingly, with the present invention, the first period is optimized whereby low power consumption of the solenoid valve 10 can be realized. In addition, by recognizing the timing at which the transition from the first period to the second period occurs, self-diagnosis of the usage limit (lifespan) of the solenoid valve 10 is enabled, and as a result, reliability of the solenoid valve 10 can be improved.

From this fact, with the present embodiment, even in the case that an electronic component such as a position sensor (e.g., the position sensor as disclosed in Japanese Patent No. 3530775) is not installed in the solenoid valve 10, since the first period can be optimized, a reduction in cost of the solenoid valve 10 and the solenoid valve driving circuit 16 can be realized.

Incidentally, during the first period, the current I that flows in the solenoid coil 18 increases rapidly over time immediately after start of application of the voltage V, and when a magnetomotive force (activation force) caused by the current I is applied with respect to the movable core (plunger) that constitutes the solenoid valve 10 and to the valve body installed on the end of the plunger, the movable core is attracted to a fixed core (iron core) of the solenoid valve by the activation force, whereupon over time the increased current decreases in value slightly. More specifically, concerning the increased current I after start of application of the voltage V, the current value thereof reaches a maximum (activation current value I1) immediately before the plunger and the valve body start to be attracted with respect to the iron core, and thereafter, upon start of attraction of the plunger and the valve body with respect to the iron core, the current value begins to decrease. Then, when the plunger and the valve body have been attracted to the iron core, activation of the solenoid valve 10 is completed.

However, conventionally, there has been a concern that after the movable core and the valve body have been attracted to the iron core, the movable core and the valve body could possibly separate away from the iron core, thereby releasing the attracted state. Thus, in terms of design considerations, the current I continues to be applied to the solenoid coil 18, whereby the attracted state is maintained for a predetermined time period following completion of activation of the solenoid valve 10, and thereafter, transition to the second period is carried out (refer to the one-dot-dash line of FIG. 2B).

Stated otherwise, in the conventional art, even if there is no fear of the attracted state being released during the first period, the current I continues to flow in the solenoid coil 18 inadvertently. Accordingly, the length of the first period becomes longer, and the activation current value also becomes larger. Thus, electrical energy tends to be consumed needlessly.

Consequently, with the present embodiment, the maintaining state transition determining unit 54 is capable of selecting, as a transition timing from the first period to the second period, any time between first to fourth times, consisting of (1) a first time (time t1), (2) a second time (an arbitrary time from time t1 to time t2), (3) a third time (time t3), and (4) a fourth (time t8). Therefore, flexibility in design can be achieved, and furthermore, inadvertent supply of electrical energy needlessly with respect to the solenoid coil 18 can be avoided. Accordingly, with the present embodiment, no matter what time is selected, lower consumption of energy during the first period can be realized.

For example, in the case that the first time t1 is selected, subsequent to the time t1, because attraction is initiated and then the current value decreases, upon completion of attraction, the solenoid valve can transition to the maintained state smoothly. Further, in the case that the second time t2 is selected as well, upon completion of attraction, the solenoid valve can transition to the maintained state smoothly. Furthermore, in the case that the third time t3 is selected, since the solenoid valve transitions to the maintained state only after completion of attraction has been confirmed, any fear of the attracted state being released can be avoided.

Still further, in the event that time t8 is selected, due to ON and OFF operations of the switching unit 34 based on supply of the control signal Sc, the power source voltage V0 is applied repeatedly to the solenoid coil 18, and within the time band from time t3 to time t8, the attracted state can be retained without the current value becoming greater than the activation current value I1. Further, in the time interval T19, after the current value is lowered from I1 to 13 within the time interval T18 that acts as a rest interval, because the power source voltage V0 is applied repeatedly to the solenoid coil 18 over the period of the time interval T10, the driven state of the solenoid valve 10 can easily be maintained. Accordingly, since the solenoid valve can transition to the maintained state after retention of the attracted state without requiring a large current value, releasing of the attracted state can be avoided reliably.

In this manner, in the time band from the first time to the fourth time, if the time t3 is selected in particular, low power consumption of the solenoid valve 10 is enabled, together with avoiding release of the attracted state.

Further, the switch controller 30 of the solenoid valve driving circuit 16 includes the current monitoring unit 56 for setting the length of the first period longer such that the activation current value I1, which is a maximum value of the current I during the first period, becomes large, and the lifespan determining unit 58, which determines whether or not the activation current value I1 is greater than the predetermined threshold value Ith. In the case that the activation current value I1 exceeds the predetermined threshold value Ith, the lifespan determining unit 58 externally outputs as a usage limit notification signal St that the solenoid valve 10 has reached its usage limit.

When the solenoid valve 10 is used over a prolonged period, as shown in FIG. 6A, a response delay (T5→T5'→T5") in activation of the solenoid valve 10 is generated, and therefore, as shown in FIG. 6B, in order to compensate for such a response delay, the current monitoring unit 56 controls a control signal supply unit 50 so that the activation current value is made larger (I1→I1'→I1"). However, if the activation current value becomes larger than a predetermined current threshold Ith, problems occur in that low power consumption and responsiveness of the solenoid valve 10 cannot be assured. Consequently, by means of the lifespan determining unit 58 externally outputting the usage limit notification signal St, a user can easily recognize that the solenoid valve 10 has reached its usage limit (lifespan).

Further, the lifespan determining unit 58 determines whether or not the first period has become longer than the period threshold T5*th*, and in the case that the first period is longer than the period threshold T5*th*, the fact that the solenoid valve 10 has reached its usage limit may also be output externally as the usage limit notification signal St.

In this case as well, if the first period becomes longer than the period threshold T5*th*, problems occur in that responsiveness of the solenoid valve 10 cannot be assured. Thus, by externally notifying that the usage limit has been reached, a user can easily recognize that the solenoid valve 10 has reached its usage limit (lifespan).

In this manner, by providing the lifespan determining unit 58 in the solenoid valve driving circuit 16 and the solenoid valve 10, since the solenoid valve 10 is equipped with a self-diagnosing function (usage period determining function), reliability of the solenoid valve driving circuit 16 and the solenoid valve 10 can be further enhanced.

Furthermore, because the switch controller 30 is equipped with the current change rate calculating unit 52 and the maintaining state transition determining unit 54, and further controls ON and OFF states of the switching unit 34, low power consumption of the solenoid valve 10 can easily be realized. Further, because the current I is detected in the current detector 36, and based on the detected current I, the switch controller 30 determines timings for the first period and the second period, the present embodiment can easily be applied to pre-existing solenoid valve driving circuits and solenoid valves.

In this case, based on input of the judgment signal Sm, during operation of the solenoid valve 10, the control signal supply unit 50 of the switch controller 30 supplies pulses, responsive to the current value and the current change rate of the current I, as a control signal Sc to the switching unit 34. Since ON and OFF states of the switching unit 34 are controlled, the current value of the current I during the first period and the second period can easily be controlled.

Still further, because the LED 24 is made to emit light when the DC power source 12 applies the power source voltage V0 to the switch controller 30, by visually confirming light from the LED 24, a user can easily grasp that the solenoid valve 10 is currently under operation.

The present invention is not limited to the aforementioned embodiment. It goes without saying that various additional structures and/or modifications could be adopted without departing from the essence and scope of the present invention as set forth in the appended claims.

What is claimed is:

1. A solenoid valve driving circuit for driving a solenoid valve by applying a first voltage with respect to a solenoid coil of the solenoid valve during a first period, and for maintaining a driven state of the solenoid valve by repeatedly applying pulse voltage at substantially the same voltage level as the first voltage, as a second voltage with respect to the solenoid coil during a second period following the first period, comprising:

a current detector that detects a current that flows in the solenoid coil;

a rate of change over time calculating unit configured to calculate a rate of change over time of the current; and a maintaining state transition determining unit configured to determine a transition from the first period to the second period based on the rate of change over time, wherein after the first voltage with respect to the solenoid coil is applied, the rate of change over time becomes substantially zero at a first time, and a current value of the current decreases at a second time after the first time, and wherein the maintaining state transition determining unit selects, as a point of transition from the first period to the second period, either a third time, which is when the current value has increased back to the current value at the first time and which is after the second time, or a fourth time which is after the third time and which is after the current value at the first time has been maintained.

2. The solenoid valve driving circuit according to claim 1, wherein the maintaining state transition determining unit is capable of selecting, as a transition timing from the first period to the second period, any time between the first to fourth times.

3. The solenoid valve driving circuit according to claim 1, further comprising:

an activation current setting unit that sets the first period longer such that an activation current value, which is a maximum value of the current during the first period, becomes large; and a usage limit determining unit configured to determine whether or not the activation current value exceeds a current threshold, and that externally notifies that the solenoid valve has reached a usage limit in the case that the activation current value exceeds the current threshold.

4. The solenoid valve driving circuit according to claim 1, further comprising:

a usage limit determining unit configured to determine whether or not the first period is longer than a time period threshold, and that externally notifies that the solenoid valve has reached a usage limit in the case that the first period is longer than the time period threshold.

5. The solenoid valve driving circuit according to claim 1, further comprising:

a switching unit that applies the first voltage to the solenoid coil by being turned ON during the first period, and that repeatedly applies the second voltage to the solenoid coil by being repeatedly turned ON or OFF during the second period; and a switch controller comprising the rate of change over time calculating unit and the maintaining state transition determining unit, for controlling ON and OFF states of the switching unit.

6. The solenoid valve driving circuit according to claim 5, wherein the switch controller further comprises a control signal supplying unit that supplies a first control signal to the switching unit during the first period to turn ON the switching unit, and that supplies a second control signal to the switching unit during the second period to repeatedly turn the switching unit either ON or OFF based on the transition from the first period to the second period determined by the maintaining state transition determining unit.

7. The solenoid valve driving circuit according to claim 5, wherein:

the solenoid coil is connected electrically to a power source via the solenoid valve driving circuit;

a power source voltage of the power source is applied as the first voltage from the power source to the solenoid coil via the solenoid valve driving circuit by turning ON the switching unit during the first period; and a power source voltage of the power source is repeatedly applied as the second voltage from the power source to the solenoid coil via the solenoid valve driving circuit by repeatedly turning ON or OFF the switching unit during the second period.

8. The solenoid valve driving circuit according to claim 7, further comprising a light emitting diode connected electrically between the power source and the switch controller, and which emits light when the power source applies the power source voltage to the switch controller.

9. A solenoid valve including a solenoid valve driving circuit for driving the solenoid valve by applying a first voltage with respect to a solenoid coil of the solenoid valve during a first period, and for maintaining a driven state of the solenoid valve by repeatedly applying pulse voltage at substantially the same voltage level as the first voltage, as a second voltage with respect to the solenoid coil during a second period following the first period, the solenoid valve driving circuit comprising:

a current detector that detects a current that flows in the solenoid coil;

a rate of change over time calculating unit configured to calculate a rate of change over time of the current; and a maintaining state transition determining unit configured to determine a transition from the first period to the second period based on the rate of change over time, wherein after the first voltage with respect to the solenoid coil is applied, the rate of change over time becomes substantially zero at a first time, and a current value of the current decreases at a second time after the first time, and wherein the maintaining state transition determining unit selects, as a point of transition from the first period to the second period, either a third time, which is when the current value has increased back to the current value at the first time and which is after the second time, or a fourth time which is after the third time and which is after the current value at the first time has been maintained.

10. A solenoid valve driving method for driving a solenoid valve by applying a first voltage with respect to a solenoid coil of the solenoid valve during a first period, and for maintaining a driven state of the solenoid valve by repeatedly applying pulse voltage at substantially the same voltage level as the first voltage, as a second voltage with respect to the solenoid coil during a second period following the first period, comprising the steps of:

detecting a current that flows in the solenoid coil;

calculating a rate of change over time of the current;

determining transition from the first period to the second period based on the rate of change over time, wherein after the first voltage with respect to the solenoid coil is applied, the rate of change over time becomes substantially zero at a first time, and a current value of the current decreases at a second time after the first time; and selecting, as a point of transition from the first period to the second period, either a third time, which is when the current value has increased back to the current value at the first time and which is after the second time, or a fourth time which is after the third time and which is after the current value at the first time has been maintained.

* * * * *